US005803883A

United States Patent [19]

Patrylák et al.

[11] Patent Number: 5,803,883

[45] Date of Patent: Sep. 8, 1998

[54] MUSCLE TONE UP DEVICE FOR THE FRONT AND BACK SIDE OF THE THIGH

[75] Inventors: Ján Patrylák, Lúčky; Jiří Pyrta, Liptovský Mikuláš, both of Slovakia

[73] Assignee: Vojtech Druska, Slovakia

[21] Appl. No.: 682,600

[22] PCT Filed: Nov. 16, 1995

[86] PCT No.: PCT/CZ95/00026

§ 371 Date: Oct. 7, 1996

§ 102(e) Date: Oct. 7, 1996

[87] PCT Pub. No.: WO96/15831

PCT Pub. Date: May 30, 1996

[30] Foreign Application Priority Data

Nov. 24, 1994 [CZ] Czech Rep. ..... 2897-94

[51] Int. Cl.[6] ..... A63B 21/00

[52] U.S. Cl. ..... 482/133; 482/100; 482/137; 482/142

[58] Field of Search ..... 482/97, 100, 112, 482/113, 133, 134, 137–139, 142, 148

[56] References Cited

U.S. PATENT DOCUMENTS

| | | | |
|---|---|---|---|
| 4,407,496 | 10/1983 | Johnson | 482/139 X |
| 4,502,681 | 3/1985 | Blomqvist . | |
| 4,542,900 | 9/1985 | Ray . | |
| 4,765,616 | 8/1988 | Wolff . | |
| 5,011,142 | 4/1991 | Eckler . | |
| 5,020,797 | 6/1991 | Burns . | |
| 5,209,223 | 5/1993 | McGorry et al. | 482/100 X |
| 5,338,274 | 8/1994 | Jones | 482/100 |

FOREIGN PATENT DOCUMENTS

| | | | |
|---|---|---|---|
| 2045215 | 2/1971 | France | 482/139 |
| 89 10 084 | 11/1989 | Germany . | |
| 2 195 552 | 4/1988 | United Kingdom . | |

*Primary Examiner*—Richard J. Apley
*Assistant Examiner*—John Mulcahy
*Attorney, Agent, or Firm*—Burns, Doane, Swecker & Mathis, L.L.P.

[57] ABSTRACT

Taught herein is a strengthening device adaptable for the front and back side of the thighs comprising a solid or rigid frame, a weight set, connected with a swinging arm, the free end of which is provided with an action rest, and a seat which is freely movable forward and backward with respect to the swinging arm. An exercising person sits in the seat and kicks the swinging arm forward or backward, depending on the version of operation, against the tension provide by the force of gravity on the weight set as it is being lifted upward by a cable connect to the swinging arm. The sliding seat reduces negative reaction forces on the exerciser, and obviates the need for hand grips or straps.

8 Claims, 2 Drawing Sheets

MUSCLE TONE UP DEVICE FOR THE FRONT AND BACK SIDE OF THE THIGH

FIELD OF THE INVENTION

This invention is related to a device for toning up the muscles, i.e. strengthening the muscle, in the front and back side of the thigh, especially the quadriceps femoris and biceps femoris.

BACKGROUND OF THE INVENTION

Devices currently available for leg exercising strengthen up the muscle primarily in the front side of the thigh by a forward kicking motion. Typically such a device is provided with a solid fixed seat and a swinging arm connected to one or more weights. A person exercising on such a device sits with his knees folded with the lower part of his shins resting on the free end. i.e., non weighted end, of the arm swinging arm. As the person exercising moves his legs forward, the swinging arm swings outward, against the traction of the weight, from the nearly perpendicular position in a bow shaped motion, into a horizontal position. This motion, damped by the tension of the weights, puts pressure on the lower part of the thigh at the edge of the seat and the hardened thigh muscles act as a two-armed lever on the edge of the seat. During this swing motion of the legs, the trunk of the person exercising tends to lift over the seat to counter the pressure exerted on the swinging arm, but is prevented from doing so by pulling on the hands holding handles on the sides of the seat and/or by fastening of the body to the seat with a belt. This tendency of the trunk to lift over the seat causes problems with use of other muscle groups during the exercise and an unpleasant psychological sensation.

For strengthening of the back side of a thigh exercise devices enabling the exerciser to "kick back" are usually employed. Such kick back devices fall into three categories:

One type, which requires the person to be in a standing position, has the disadvantage of exercising only one leg at a time, while the other leg is use to support and stabilize the person's body.

Devices of the second type are designed for kicking back both legs as the person exercising is laying on his belly. A notable disadvantages of this type of leg strengthener is the difficult of fixation of the body requiring fixation with the hand. This type also tend to inhibit breathing as the trunk is pulled to lift the calf of the leg causing an unpleasant feeling.

The third group of the devices is for kicking back in sitting position, and has the disadvantage that the front part of the thighs, which are closely over the knees, rest on a solid thigh grip, being the knees downward. Thus, the front side of the thighs and the muscle of the belly are more exerted, which is particularly a disadvantage for the person recovering from surgery in or near the abdominal area.

It is an object of the present invention to provide a device for toning up the muscle groups of the front and back side of the thighs without the disadvantages of the devices of the art.

SUMMARY OF THE INVENTION

The present invention provides for a strengthening device for the muscle groups of the front or back side of the thighs of a human comprising:

1) a rigid frame having a horizonal base and a vertical part substantially perpendicular to the base;
2) a swinging arm having,
   i) a rotation axle fastened to the vertical part of the rigid frame,
   ii) a free end distal to the rotation axle with the free end being provided with an action rest, and
   iii) a reaction rest between the rotation axle and the free end;
3) a weight set capable of vertical movement;
4) a kinematic connecting means whereby the weight set is connected to the swinging arm;
5) a weight lifting means whereby rotation of the swinging arm about its rotational axle acts through the kinematic connecting means to lift the weight set;
6) a seat having a back, front, and a seating surface; and
7) a sliding mean whereby the seating surface of the seat is attached to the horizonal base of the rigid frame so that the seat is free to move within a fixed range, forward or backward with respect to the swinging arm and in a plane parallel to the vertical part of the rigid frame during operation of the device.

BRIEF DESCRIPTION OF THE DRAWINGS

The invention may be understood by reference to the following description in conjunction with the following figures, in which.

DESCRIPTION OF THE PREFERRED EMBODIMENT

As used herein with regard to muscles the terms "toning," "toning up," "strengthening," and "exercising" are used interchangeably. Also, the terms "device" and "equipment" are synonymous as used herein when referring to an apparatuses for exercising. For simplicity, when referring to a single person, only the masculine pronouns have been used, but it is to be understood that feminine pronouns equally apply.

The disadvantages of the leg muscle toning devices of the art are eliminated with the present invention, which can be used for exercising both the front and back side of the thighs. The innovative aspect of the invention lies in minimizing the detrimental movement of those parts of the body which are not taking part in the exercise by the forward and backward movement of the seat, which enables a substantially rigid or firm fixation of the legs without corrective motion of the rest of the body. With this higher level of the fixation of the body, the hands of the exercising person are free, because there is no need to hold handles as with most of the devices of the art. Further, only the desired parts of the legs are under tension, while the other muscle groups of the body are relaxed resulting in a very pleasant physical sensation during the exercise and enabling a higher number of repetitions of each exercise or a exercising at a higher load.

In the version for strengthening back side of the thighs, e.g. the device is configured for kicking back, the reaction rest is situated over the tangent of the upper surface of the action rest and the front edge of the seat. The upper surface of the action rest can be formed to fit, i.e., "profiled to", the lower part of the calf and the lower surface of the reaction rest can be formed to fit the upper part of the shin.

In the version for strengthening the front part of the thighs, e.g. the device is configured for kicking forward, the reaction rest is situated under the tangent of the lower surface of the action rest and the front edge of the seat. The lower surface of the action rest can be formed to fit the lower part of the shin bone and the upper part of the reaction rest can be formed to fit the upper part of the calf.

The rests can be made movably on the swinging arm to allow adjustments for person of different height. The free end of the swinging arm, i.e., the end furthest from the seat (distal end), can be below the action rest to provided a support for the soles of the feet or the toes. This enables an even better gripping of the under knee parts of the legs and higher exercise efficiency. The degree of body fixation possible with the present invention is not possible in the devices of the art where supports have been used for the have correcting of the movement of the limbs. The seat of the present device can be provided with a locking means for the entering and the leaving position to enable a comfortable and safe entering and leaving especially for elderly or less mobile persons.

Figure 1:
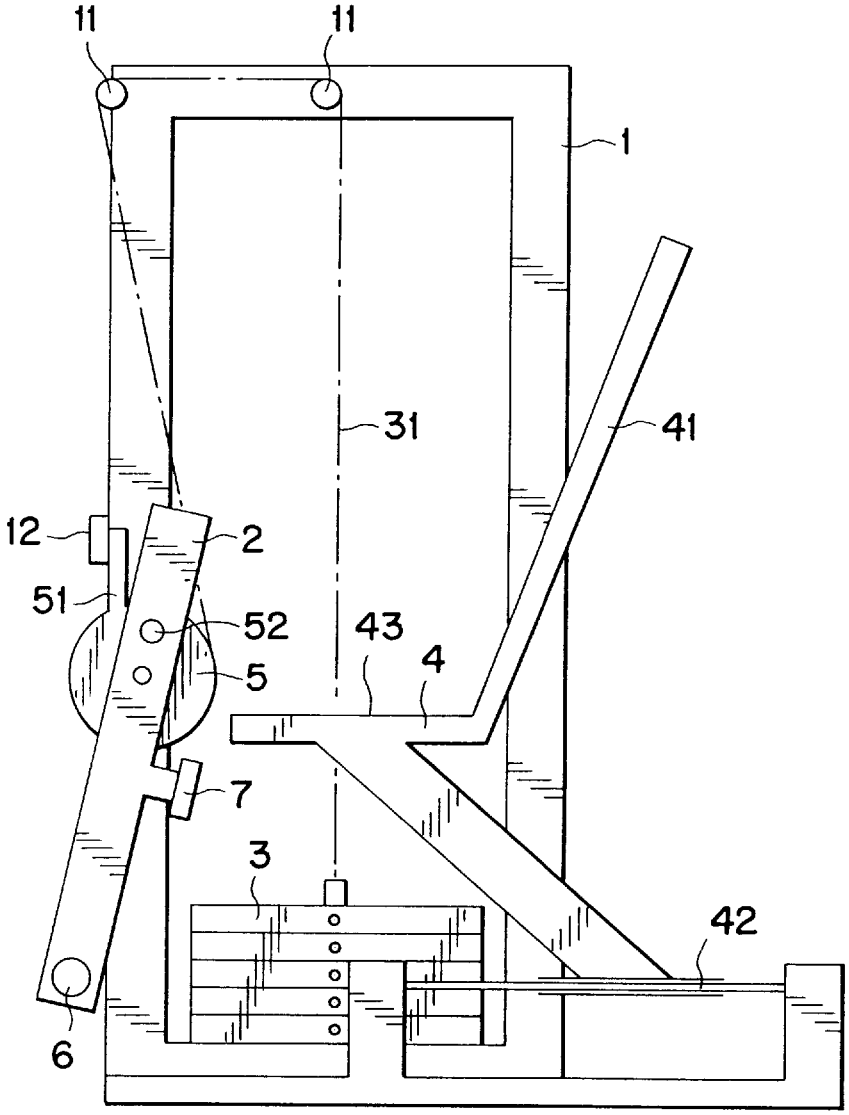
FIG. 1 shows a side view the strengthening device of the present invention in the forward kicking version showing the frame, weights, movable arm, sliding seat, and connecting cable.

Referring now to FIG. 1, the present device in the version for exercising the front side of the thighs, consist of a rigid or firm frame 1 having a vertical and a horizonal part, a swinging arm 2 mounted to the vertical porsion of the frame I with a pivot pin so that the swinging arm 2 is free to pivot about the pivot point in a plane parallel to the vertical section of the frame 1, selectable weight set 3 and a seat 4 with back rest 41. The pivot point, i.e., the rotational axle, is located between the midpoint of the swinging arm 2 and an end, so that the swinging arm 2 is asymmetric with respect to the pivot point creating a proximal end and a distal end with respect to the seat. As used herein, the distal end is also referred to as the "free end."

The frame 1 is provided with pulleys 11 over which rides a cable 31 connecting the weight set 3 to a cylindrical upwinding drum 5 the center axis of which is coaxial with the pivot point of the swinging arm 2. The upwinding drum 5 has a mandrel 51 protruding from its circumference, and at the rest position of the swinging arm 2, the mandrel 51 is sitting against the upper stop 12 which is fastened onto the vertical part of the frame 1. The swinging arm 2 is connected to the upwinding drum 5 through the coupling pin 52 mounted eccentrically to the rotation axle of the swinging arm 2 in the one of the two possible positions corresponding to the swinging arm 2 being in substantially vertically. The swinging arm 2 on its free end is provided with the action rest 6, and closer to the pivot point or rotation axle, with the reaction rest 7.

As the swinging arm 2 moves outward, the upwinding drum 5 rotates in clockswise manner, and the cable 31 is wound around the circumference of the upwind drum 5 pulling the weight set upward and putting tension on the cable 31. The tension acts upon the swinging arm 2 as its free end is moved outward with respect to the seat. The mutual position of the rests 6, 7 is such that the reaction rest 7 is set under the tangent of the lower surface of the action rest 6 and the front edge of the seat 4. The lower surface of the action rest 6 is formed for leaning the lower part of the shin and the part behind the instep, the upper part of the reaction rest 7 is profiled for leaning the upper part of the calf.

In preparation for operation of the device, the coupling pin 52 is pulled out and the balanced swinging arm 2 now uncoupled form upwinding drum 5 and free to rotate is displaced to a position appropriate for a comfortable entering. After entry, the coupling pin 52 is released, and pushed to the working position so the kinematic coupling between the weight set 3 and the swinging are 2 is made. The exercising person sits in the seat 4 with the back portion of his upper calves resting against reaction rest 7 and his toes secured behind action rest 6, i.e., on the same side of the swinging arm 2 as the reaction rest 7, so that an extended imaginary line passing through the axis of rotational axis of the swinging arm 2 also passes through the pivot points of the person's knees.

To operate the devise, the person kicks outward causing the free end of the swinging arm 2 to pivot upward causing the swinging arm 2 and upwinding drum 5 to rotate clockwise (with respect to the exercising person) and the cable 31 to wind around the upwinding drum 5. In turn, this action causes the weight set 3 to move upward from its resting position, and the gravitational force acting on the weight set 3 is transmitted through the cable 31 placing tension on the swinging arm 2 which resists its clockwise rotation.

The seat 4 with the sitting surface 43 is set in a linear guide 42 so that it is freely movably in the forward-backward direction with respect to the swinging arm 2. As the exercising person kicks outward, the reaction force against the person causes the seat 4 to move. Forward and backward movements of the exercising person's trunk are corrected with sliding of the seat 4 in the guide 42. The muscle groups other than those associated with the legs are without load and the hands are free. Conversely, as the exercising person relaxes and his legs move downward, the force on the person reverses and the seat 4 moves forward. Thus, the reaction force from an outward kick is absorbed by forward-backward translation of the exercising person. Therefore, there is no need for the exercising person to grip fixed handles or to be strapped in the seat. To facilitate entering and leaving, seat 4 is provided with a means (not shown in FIG. 1 or FIG. 2) of locking it in place with respect to the linear guide 42 preventing undesired movement.

During the exercise on the device in the version for exercising the front of the thighs as shown in FIG. 1, the exerciser is acting on the lower surface of the action rest 6 and the reaction force causes a pressure of the upper part of the calf to the reaction rest 7. No other influence of the reaction force is manifested, as the part of the leg under the knee is acting as a single arm lever with a rotation axle in the knee joint.

Figure 2:
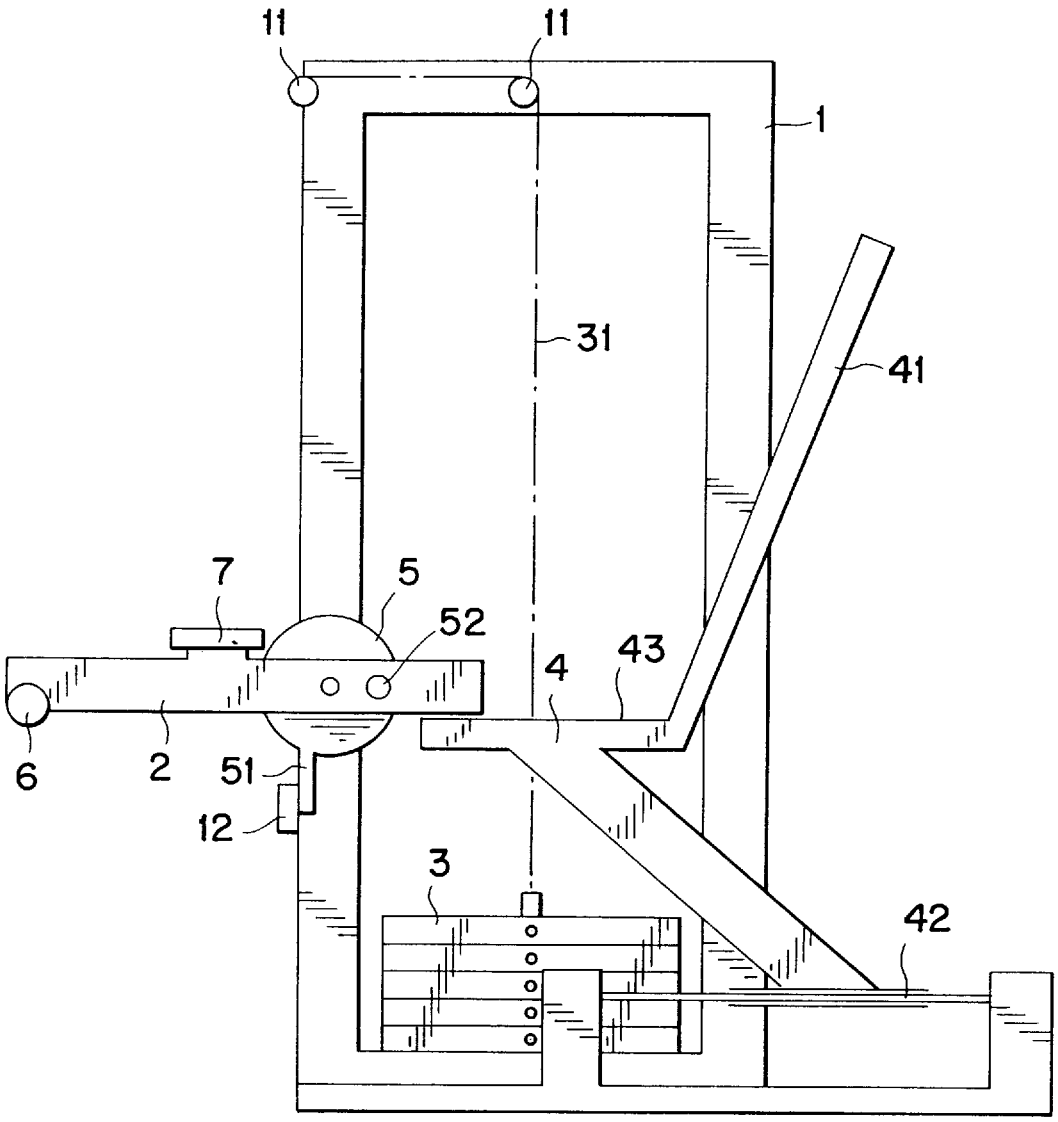
FIG. 2 shows a side view the strengthening device of the present invention in the backward kicking version showing the frame, weights, movable arm, sliding seat, and connecting cable.

Referring now to FIG. 2, the configuration of the device for strengthening the back side of the thighs differs with regard to the arrangement of swinging arm 2, upwinding drum 5, and the rests 6, 7. The reaction rest 7 is set over the tangent leading from the upper surface of the action rest 6 to the front edge of the seat 4. The upper surface of the action rest 6 is then profiled to fit of the lower part of the calf and the lower surface of the reaction rest 7 is profiled to fit the upper part of the shin. The lower free end of the swinging arm 2 is under the action rest 6 provided with a support (not shown) of the sole or toes.

During the exercise for the back side of the thighs, the exercising person is acting on the upper surface of the action rest 6 and the reaction force causes a pressure of the upper part of the shin to the reaction rest 7. The action and reaction forces are acting the same way as in the previous case, only the direction of the forces is opposite to the directions during the exercise for the front portion of the thighs. The outer manifestation of the forces and the function of the seat 4 are the same.

By removing the swinging arm 2 off the pivot pin, moving the mandrel 51 of the upwind drum 5 off upper stop 12, rotating upwind drum 5 clockwise about a half turn and placing the mandrel 51 against the front side (with respect to the seat) of the lower stop 12, the swinging arm 2 is reversed and replaced on the pivot pin. Finally the coupling pin 52 is placed through the swing arm 2, into the slot of the upwind drum 5 corresponding to the configuration for exercising the back of the thighs. The exercising person starts the exercising cycle with legs straight out and kicks backward causing the upwind drum 5 to rotate counter clockwise. As stated previously, the principle of operation is analogous to exercising the front portion of the thighs.

What is claimed is:

1. A strengthening device for the muscle groups of the front or back side of the thighs of a human comprising:

1) a frame having a horizonal base and a vertical part substantially perpendicular to the base;

2) a swinging arm having, i) a rotation axle fastened to the vertical part of the frame, ii) a free end distal to the rotation axle with the free end being provided with an action rest, and iii) a reaction rest between the rotation axle and the free end;

3) a weight set capable of vertical movement;

4) a kinematic connecting means whereby the weight set is connected to the swinging arm;

5) a weight lifting means whereby rotation of the swinging arm about its rotational axle acts through the kinematic connecting means to lift the weight set;

6) a seat having a back, front, front edge, and a seating surface; and 7) a sliding means whereby the seating surface of the seat is attached to the horizonal base of the frame so that the seat is free to move within a fixed range, forward or backward with respect to the swinging arm and in a plane parallel to the vertical part of the frame during operation of the device.

2. A strengthening device according to claim 1, wherein the reaction rest is situated above a tangent to an upper surface of the action rest and a front edge of the seat, and wherein the upper surface of the action rest is profiled to receive a lower part of the calf and wherein a lower surface of the reaction rest is profiled to receive an upper part of the shins.

3. A strengthening device according to claim 1, wherein the reaction rest is situated under a tangent to a lower surface of the action rest and a front edge of the seat, wherein the lower surface of the action rest is profiled to receive a lower part of the shins and wherein an upper surface of the reaction rest is profiled to receive an upper part of calf.

4. A strengthening device according to claim 1, wherein the action rest and reaction rest are fastened adjustably onto the swinging arm.

5. A strengthening device according to claim 1, wherein the kinematic connecting means is a cable and upwind drum.

6. The strengthening device according to claim 1, wherein the swinging arm is positioned to strengthen the font muscle groups of a human's thighs.

7. A strengthening device according to claim 1, wherein the frame is rigid.

8. A strengthening device according to claim 1, wherein the swinging arm is positioned to strengthen the back muscle groups of a human's thighs.

* * * * *